United States Patent [19]

Focht

[11] 3,949,910

[45] Apr. 13, 1976

[54] DISPENSING PUMP

[75] Inventor: John Richard Focht, Yonkers, N.Y.

[73] Assignee: Precision Valve Corporation, Yonkers, N.Y.

[22] Filed: Aug. 12, 1974

[21] Appl. No.: 496,883

Related U.S. Application Data

[63] Continuation-in-part of Ser. No. 420,234, Nov. 29, 1973, abandoned.

[52] U.S. Cl. ..... 222/321

[51] Int. Cl.[2] ..... B67D 5/42

[58] Field of Search ..... 222/385, 383, 321; 239/321, 329, 331, 333, 350; 417/511; 137/539, 543.19, 543.21

[56] References Cited

UNITED STATES PATENTS

| | | | |
|---|---|---|---|
| 3,187,960 | 6/1965 | Gorman | 222/321 |
| 3,463,093 | 8/1969 | Pfeiffer et al. | 222/321 X |
| 3,483,888 | 12/1969 | Wurzel | 137/539 |

*Primary Examiner*—Robert B. Reeves
*Assistant Examiner*—John P. Shannon
*Attorney, Agent, or Firm*—Davis, Hoxie, Faithfull & Hapgood

[57] ABSTRACT

An inexpensive, container mounted, plastic dispenser pump for dispensing a product from the container is leak-proof in its rest position since neither the outlet valve nor the atmospheric container vent open in response to container pressure or positional attitude of the dispenser. The outlet valve is positive in action since it is opened by relative movement of pump parts during actuation. The pump inlet valve is actuated by differential pressure. The atmospheric vent for the container is blocked by the position of pump parts when at rest.

18 Claims, 7 Drawing Figures

DISPENSING PUMP

This application is a continuation-in-part of application Ser. No. 420,234, filed Nov. 29, 1973, now abandoned.

BACKGROUND OF THE INVENTION

The present invention relates to a pump for dispensing a liquid product from a container. More particularly, it relates to an inexpensive, molded plastic, reciprocating piston pump for this purpose which is leak-resistant.

Heretofore, many dispensing pumps have incorporated pressure-actuated check valves in their outlet passages. However, ball check valves are prone to leak if the pump is tipped or turned over, and all pressure-actuated check valves are prone to leak if enough pressure develops within the container. This might occur if the pump is mounted on a flexible-walled container and the container is squeezed or if the dispenser is stored in a hot environment.

SUMMARY OF THE INVENTION

The pump of the present invention comprises a pump cylinder housing, an inlet valve, an outlet valve body, a reciprocable piston and a spring for upwardly biasing the valve body and piston. The outlet valve body comprises an upstanding tubular valve stem provided with a transverse valve orifice. The reciprocable piston includes a tubular, resilient plastic skirt and an annular elastomeric sealing gasket which extends transversely across the upper end of the piston skirt and completes the fluid-displacing face of the piston. The inner margin of the gasket encompasses the valve stem to mount the piston on the outlet valve body and to normally sealingly occlude the transverse valve orifice. The piston is axially movable in response to axial movement of the valve body. The inner margin of the gasket is movable out of occlusion with the orifice in response to downward axial movement of the valve body before the piston moves.

In a preferred embodiment of the present invention, there is a transverse suction relief vent in the cylinder housing which is sealingly occluded by the piston in the rest position before the dispensing stroke.

It is an object of the invention to provide a positive action outlet valve which controls fluid egress from the dispensing pump and which is actuated by relative movement of parts during operation of the piston of the pump.

It is another object of the invention to provide an inexpensive pump which is leak-resistant in all positions and in the presence of pressure in its associated container.

DESCRIPTION OF THE PREFERRED EMBODIMENTS

Figure 1:
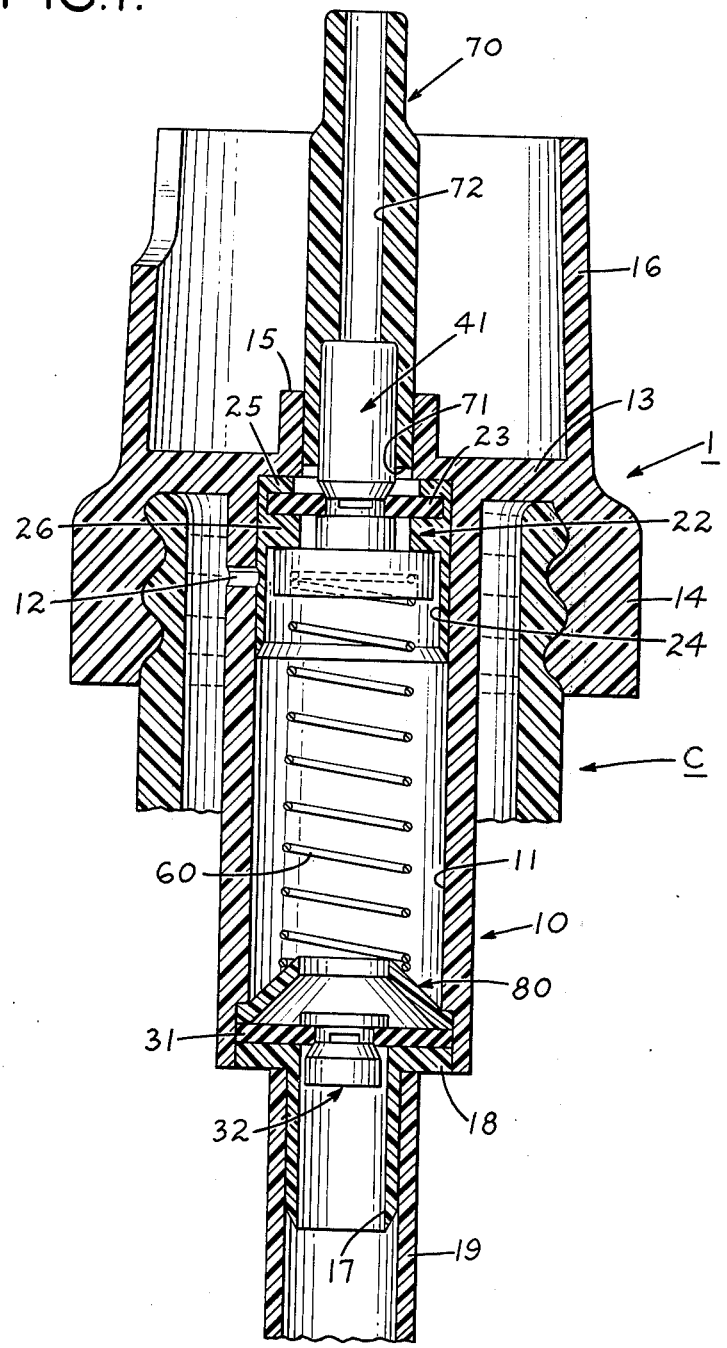
FIG. 1 is a front elevation view, partially in vertical section, of a pump made in accordance with a first embodiment of the present invention in the rest position.

The dispensing pump 1 of the present invention, illustrated in FIG. 1, has a pump housing 10 with a reciprocable piston unit within its cylindrical bore, or chamber, 11. A pressure-actuated inlet check valve mounted in the lower end of the chamber 11 controls fluid ingress to the pump chamber 11 while a positive action outlet valve on the piston unit controls fluid egress from the pump 1. The outlet valve opens independently of pressure and uses pump actuation force to open it. The pump 1 may also include a suction relief vent 12 through the wall of the housing 10 which is normally occluded by the piston unit, but communicates the container and the atmosphere when the pump is actuated. These two features render the pump 1 leak-resistant when there is pressure in the container or when the container is tipped on its side or inverted.

Figure 2:
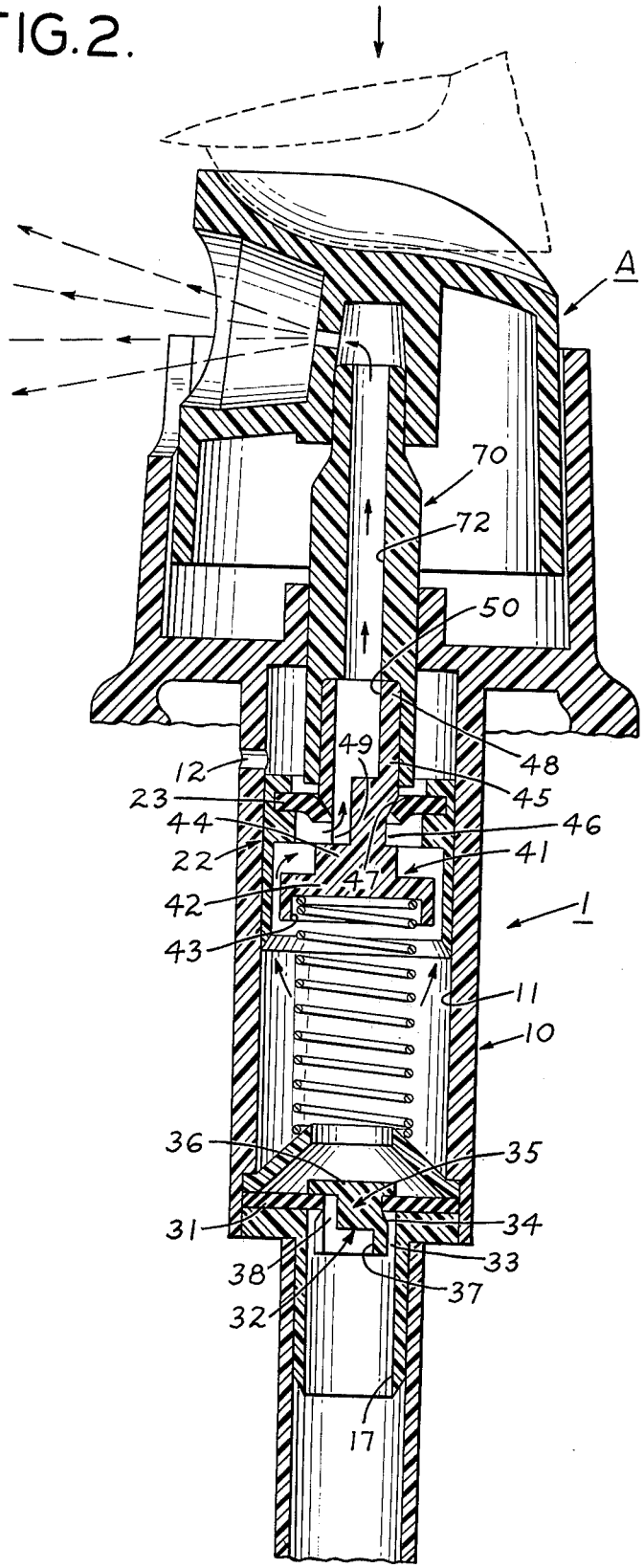
FIG. 2 is a side elevation view in vertical section of the pump of FIG. 1 during the actuation stroke.

A centrally apertured radial flange 13 integrally joins the pump housing 10 to a cap 14 for mounting the pump 1 on a product container C, such as by a threaded or crimped connection. The radial flange 13, in conjunction with the cap 14, also seals the pump housing 10 to the mouth of the product container C. The flange 13 may have an upstanding annular collar 15 surrounding the central aperture to act as a guide and as a stop to limit the downward travel of an actuator button A (FIG. 2). If desired, the cap 14 may have an upstanding circumferential rim 16 at its outer periphery to guide the vertical travel of the actuator button A. Fluid product enters the pump chamber 11 through an axial education passageway 17 in an education tube nipple 18 at the lower end of the housing 10. An eduction tube 19 is slipped over the nipple 18 to draw fluid from the bottom of the container C. A suction relief vent 12 extends transversely through the upper part of the bore 11 to vent the container only during dispensing.

The piston unit and its associated outlet valve act as an integrated unit so that the piston unit performs both pumping and valving functions. The piston unit comprises a piston body 22, an annular elastomeric gasket 23 and a valve body 41. The outlet valve also incorporates valve body 41 and gasket 23.

The piston comprises a generally tubular piston body 22 and a centrally apertured, annular sealing gasket 23 of elastomeric material. The piston body 22 includes a thin-walled, depending, annular resilient skirt 24 on the outer circumference of the piston body 22 and a pair of vertically spaced, upper and lower annular shoulders 25 and 26, respectively, which are integral with the upper interior of the piston skirt 24. The skirt 24 provides a sliding seal with the bore 11 which improves with increased internal pressure during the pumping stroke. The upper and lower shoulders 25 and 26, respectively, grip the outer margin of the annular gasket 23 so that the outer margin is sealed. The gasket 23 extends transversely across the piston body 22 to form the transverse fluid-displacing face of the piston. This gives the piston a centrally-apertured, cup configuration with the valve body 41 passing through the central aperture to form the outlet valve and extending upwardly to form a portion of a piston actuating rod.

The outlet valve comprises the gasket 23 and the valve body 41. The outlet valve body 41 (FIG. 2) includes an enlarged diameter, circular base 42 with a recess 43 in its underside for retaining return spring 60 and a centrally disposed, cylindrical pedestal 44 on its top side. Surmounting the pedestal 44 is an upstanding, tubular valve stem 45 with a reduced diameter, cylindrical neck 46 integrally joined to pedestal 44; an intermediate, upwardly and outwardly tapered frusto-conical portion 47 and a tubular cylindrical tip 48. The inner margin of the gasket 23 grips the neck 46 and parts of the frusto-conical portion 47 to interconnect the piston skirt 24 to the valve body 41 for reciprocating operation. The pedestal 44 spaces the gasket 23 from the base 42 to assure clearance for product flow and to provide freedom for operation of the outlet valve.

A transverse outlet valve orifice 49 in the neck 46 is in communication with an axially extending outlet bore 50 in the valve stem 45. The gasket 23 occludes and seals the outlet passageway 49 unless it is flexed out of the way by downward axial movement of the outlet valve body 41.

A tubular valve stem extension member 70 connects the valve stem 45 of the valve body 41 to the actuator button A. The lower end of the extension 70 provides a downward facing shoulder 71 for abutment with the gasket 23 to drive the piston 21 downwardly (see FIG. 2) The extension member 70 also includes an axial bore 72 for communication with valve stem bore 50 for conveying fluid to the actuator A. If desired, the valve stem 45 itself can be extended in length to connect it to the actuator A and can be provided with a shoulder similar to shoulder 71 for abutment with the gasket 23.

The inlet valve includes an annular elastomeric gasket 31 and an inlet valve body 32. The inlet valve body 32 comprises a cylindrical base 33; an upwardly and inwardly tapered, frustoconical shoulder 34; a reduced diameter, cylindrical neck 35 including a transverse valve orifice 38; and a surmounting cylindrical cap 36. The gasket 31 is centrally apertured so that its inner margin grips the neck 35 and a portion of the frusto-conical shoulder 34 to seal the transverse orifice 38 when the valve is closed. Cap 36 rests on the upper surface of the gasket 31. The outer margin of the gasket 31 is gripped between the bottom of housing 10 and the lower flange of a centrally apertured, frusto-conical retainer 80. Retainer 80 prevents the inlet valve body 32 from being forced free of the gasket 31. Inlet valve body 32 slides in passageway 17 of the eduction tube nipple 18.

In operation, vertical reciprocation of the actuator button A operates the dispensing pump 1. Operation commences with the piston unit in its uppermost rest position (FIG. 1), proceeds with the unit traveling downwardly in a pumping stroke (FIG. 2) until it reaches its lower limit of travel and then reverses direction to travel upwardly in a return stroke (FIG. 3) until it again reaches its rest position (FIG. 1).

In the rest position (FIG. 1), the skirt 24 covers and seals off the relief vent 12 in the wall of the cylindrical bore 11. The spring 60 biases the base 42 of the outlet valve body 41 and the lower shoulder 26 of the skirt 24 into abutment so that the gasket 23 is in its unflexed, planar condition shutting off the transverse outlet orifice 49. Since the spring 60 holds the outlet valve base 42 against the lower shoulder 26 and the upper shoulder 25 against the flange 13, the gasket 23 and outlet valve body 41 cannot be moved relative to each other by pressure in the container or in tipping or inverting the container. They can be moved relative to each other only by downward axial movement of the valve body 41. Consequently, with the cap 14 and flange 13 sealing the container mouth, the pump 1 completely seals the container interior against leaking.

Upon actuation, the reciprocable piston unit is displaced downwardly from the rest position of FIG. 1 by applying finger force to the actuator button A. The outlet valve opens before fluid pumping begins. The sequence occurs because the outlet valve body 41 is moved by the valve stem extension 70 relative to the gasket 23 and its associated piston body 22 before the shoulder 71 of the extension 70 comes to abut the outer margin of gasket 23 to move the piston. This is accomplished by making the inside diameter of the piston body 22 at its upper shoulder 25 greater than both the outside diameter of the valve stem 45 and the valve stem extension member 70 and providing vertical spacing between the valve extension shoulder 71 and the gasket 23 in rest position. As the valve stem extension member 70 and valve body 41 move axially downwardly from their rest position, the piston skirt 24 initially remains stationary and the unsupported inner margin of the gasket 23 flexes downwardly, curling out of contact with the neck 46 and opening the transverse outlet orifice 49. As the valve stem extension member 70 and valve body 41 continue downwardly with the outlet valve open, the shoulder 71 comes into engagement with the outer margin of gasket 23 and the piston body 22 starts to move downwardly with the extension 70 and valve body 41, thereby commencing pumping action. Throughout the pumping stroke the inlet valve remains closed so that fluid within the chamber 11 is pressurized and is forced upwardly around the base 42 of the valve body 41, through the transverse outlet orifice 49 in the neck 46 and then axially upwardly through the bore 50 in the valve stem 45 and the bore 72 in the valve stem extension member 70 for ultimate discharge through the actuator button A. As soon as the upper edge of the piston body 22 clears the relief vent 12, any reduction in pressure in the container C due to product displacement is relieved through the vent 12 which communicates with the atmosphere through the portion of bore 11 above the piston body 22 and a clearance between valve stem extension 70 and the guide collar 15 on the top of housing 10.

Figure 3:
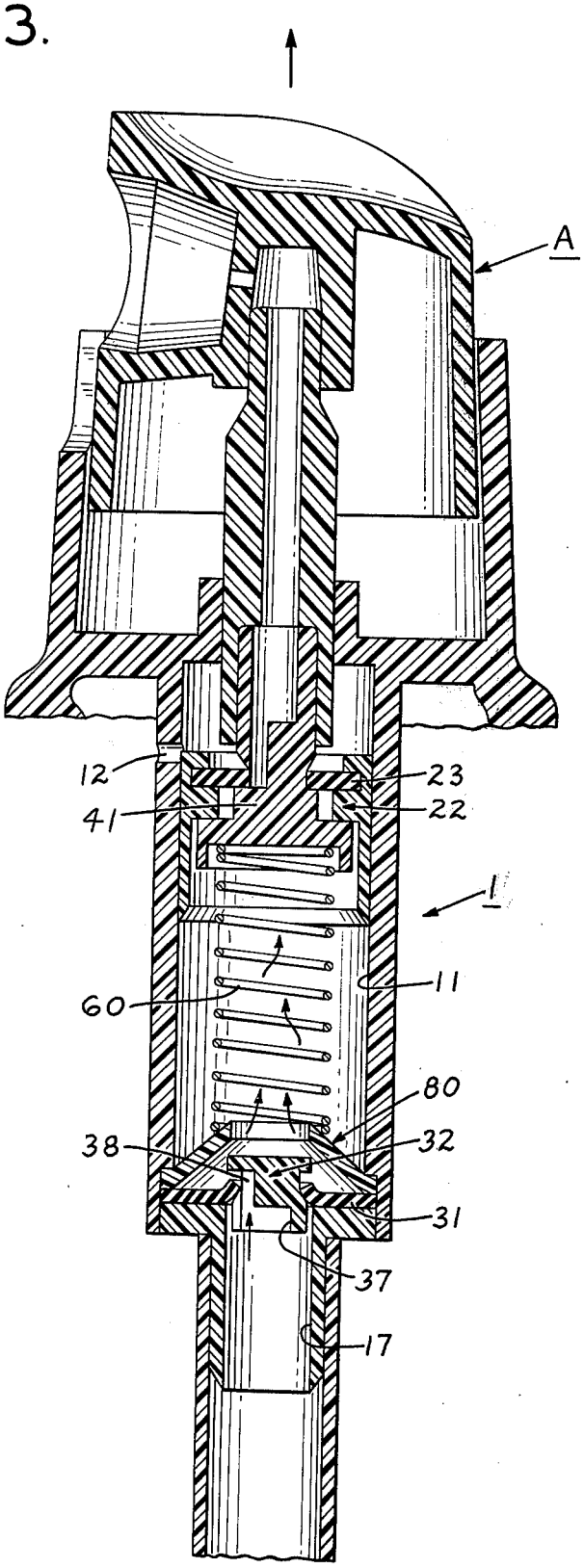
FIG. 3 is a side elevation view in vertical section of the pump of FIG. 1 during the return stroke.

The frictional bearing of the piston skirt 24 on the bore 11 tends to retard both downward and upward movement of the piston body 22 with respect to the valve body 41. This causes the piston body 22 and outer margin of the gasket 23 to lag behind the inner margin of the gasket 23 and the valve stem extension 70 during both the downward pumping stroke and the upward return stroke. Consequently, when the piston unit with its associated outlet valve reaches its lower limit of travel, the outlet valve is still open and the piston body 22 and outer margin of the gasket 23 are still lagging behind the other elements. When downward axial force on the piston unit is released, the spring 60 moves the piston unit and the actuator button upwardly on the return stroke (FIG. 3). As the return stroke commences, the frictional engagement of the skirt 24 with the bore 11 holds the piston body 22 stationary temporarily until the lower shoulder 26 of the piston body abuts the base 42 of the valve body and the inner margin of the gasket 23 returns to its planar condition, thereby closing the outlet valve orifice 49 and preventing flow through it. The continued upward movement of the return stroke reduces the pressure in pump chamber 11 and opens the inlet valve. The fluid within the eduction passageway 17 is nearly at atmospheric pressure because of vent 12. This is a higher pressure than that in the pump chamber 11. This pressure differential pushes the movable inlet valve body 32 upwardly, thereby flexing the inner margin of the gasket 31 upwardly out of engagement with the neck 35 and exposing the transverse inlet orifice 38. With the transverse inlet orifice 38 exposed, atmospheric pressure forces fluid up the eduction passageway 17, through the axial inlet passage 37 and orifice 38 into the bore 11 through the central aperture in the retainer 80. The retainer 80 prevents the inlet valve body 32 from disengaging from the gasket 31 when fluid is being sucked into the chamber 11 and the cap 36 prevents it from being driven in the opposite direction when fluid is being pumped out of the chamber 11. Any reduced pressure within the container C during the return stroke is relieved by the vent 12 until it is closed off by skirt 24.

At the conclusion of the return stroke, the pump 1 has returned to its rest position (FIG. 1) with the relief vent 12 and the inlet and outlet valves both closed, thereby sealing the container against leakage. A slight reduction in pressure in the container C due to drawing fluid into the chamber 11 after the vent 12 is closed acts as a further measure against leakage. The resultant leak-resistance of the pump 1 of the present invention is independent of both pump orientation and excessive container pressure.

Referring now to FIGS. 4–7, a second embodiment of the pump of the present invention is shown. Although substantially similar to the first embodiment, the second embodiment incorporates a number of structural differences from the first embodiment. The following description deals primarily with those differences.

The actuator button A′ and the tubular valve stem extension 70*a* are integral. The threaded cap 14*a* for mounting the pump on a container is separate from the housing 10*a* of the pump chamber 11. Cap 14*a* overlies a radially extending flange 13*a* integral with the housing to accomplish a sealed connection to the container. Cap 14*a* includes an annular downwardly directed rib 91 which bears against the gasket 23 when the pump is in the rest position. The engagement of the annular rib 91 with the gasket serves to form a seal and also forces the gasket 23 against the shoulder 26. Spring 60 forces the piston shoulder 26 against the lower face of the gasket 23 and forces the upper face of the gasket against the annular rib thereby assuring seals against leakage of product from the pump chamber 11 when the pump is at rest. Leakage past the piston unit is blocked by the seal between the rib and the upper face of the gasket 23. A small rib 25*a* at the upper edge of the piston skirt retains the gasket in the piston unit during assembly.

The inlet check valve member of the embodiment of FIGS. 4–7 is a ball 32*a* resiliently biased toward closure against a conical valve seat surface 94 by resiliently deflectable fingers 92 having inwardly and downwardly directed cam surfaces 93 which bear against the ball to urge the ball 32*a* against the seat 94. On the return stroke, the reduction in pressure in the chamber 11 causes the ball 32*a* to lift from the seat 94 to allow product to be drawn from the container into the chamber 11. Lifting of the ball 32*a* deflects the resilient fingers 92 radially outwardly as the ball bears on the cam surfaces 93. The resiliency of the plastic material of the fingers 92 tends to restore the ball to its seat 94 to close the inlet valve. The retainers 95 are wider and hence less deflectable than the fingers 92. (See FIG. 7). The retainers contact the ball 32*a* only when lifted from its seat 94 and serve to confine the ball by limiting its upward travel, thereby assuring that the ball will not be ejected from close proximity to the valve seat 94 under severe handling conditions. The resilient bias toward closure provided by the fingers 92 prevents chattering of the ball during pumping to prevent ineffective pump strokes, prevent annoying rattling of the ball, and assure proper pumping in container attitudes other than substantially upright.

Figure 4:
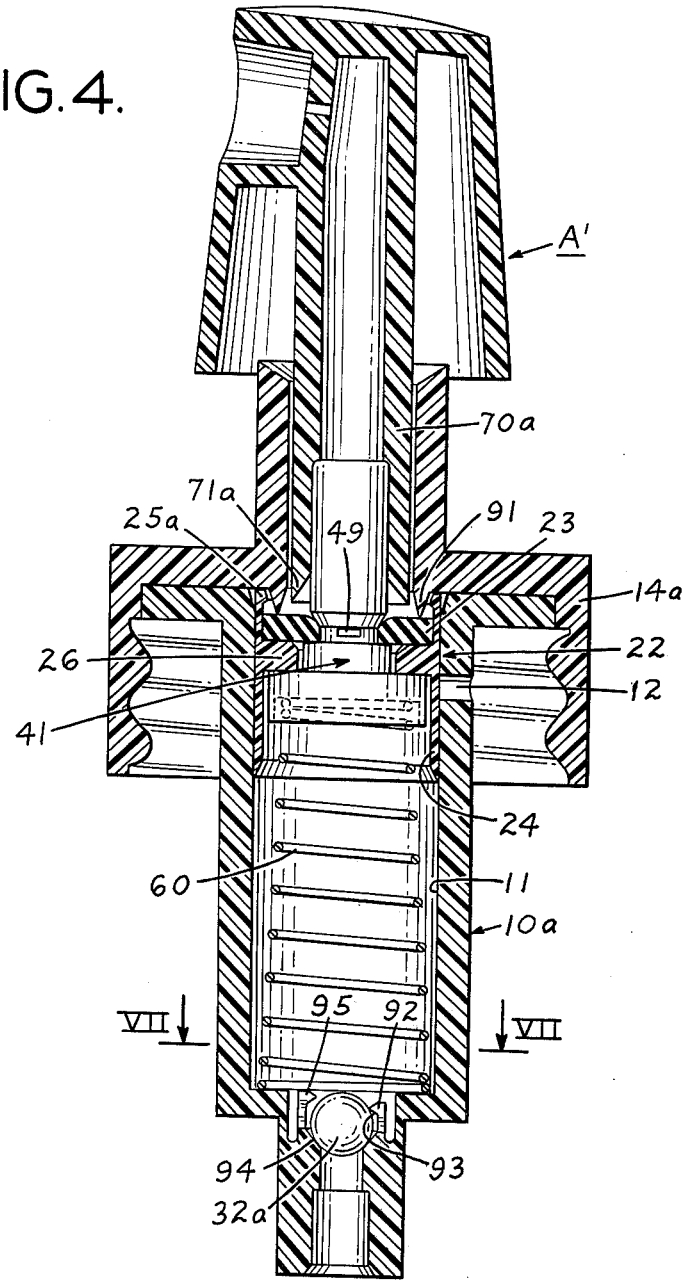
FIG. 4 is an elevational view, partially in vertical section, of a pump made in accordance with a second embodiment of the present invention in the rest position.
Figure 7:
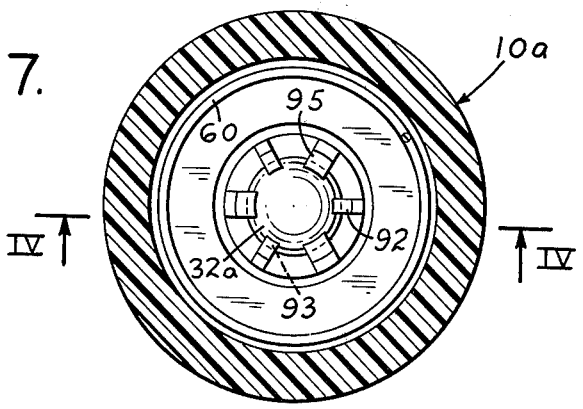
FIG. 7 is an enlarged detail view taken along line VII—VII of FIG. 4 showing the inlet valve structure.

The operation of the embodiment of FIGS. 4–7 is substantially similar to that of the embodiment of FIGS. 1–3. FIG. 4 shows the pump in the unactuated or rest position. Outlet valve orifice 49 is occluded by the inner margin of gasket 23. Vent 12 is occluded by the piston skirt 22. Inlet valve ball 32*a* is closed against seat 94 and resiliently held closed by resilient fingers 92 whose cam surfaces 93 bear against the upper portion of the ball 32*a*. The ball cannot rattle. Annular rib 91 on the inside of the cap 14*a* is in sealing engagement with the upper face of gasket 23 and maintains the lower face of the gasket against the inwardly extending annluar shoulder 26 of the piston. Pressure in the container due to expansion of the product or squeezing of the container or hydrostatic pressure due to inversion of the dispenser will not cause leakage of the product because the outlet valve is closed and does not open in response to internal pressure and other leakage paths are blocked by the entrapment of the gasket 23 between the piston shoulder 26 and the annular rib 91 under the bias of the spring 60.

Figure 5:
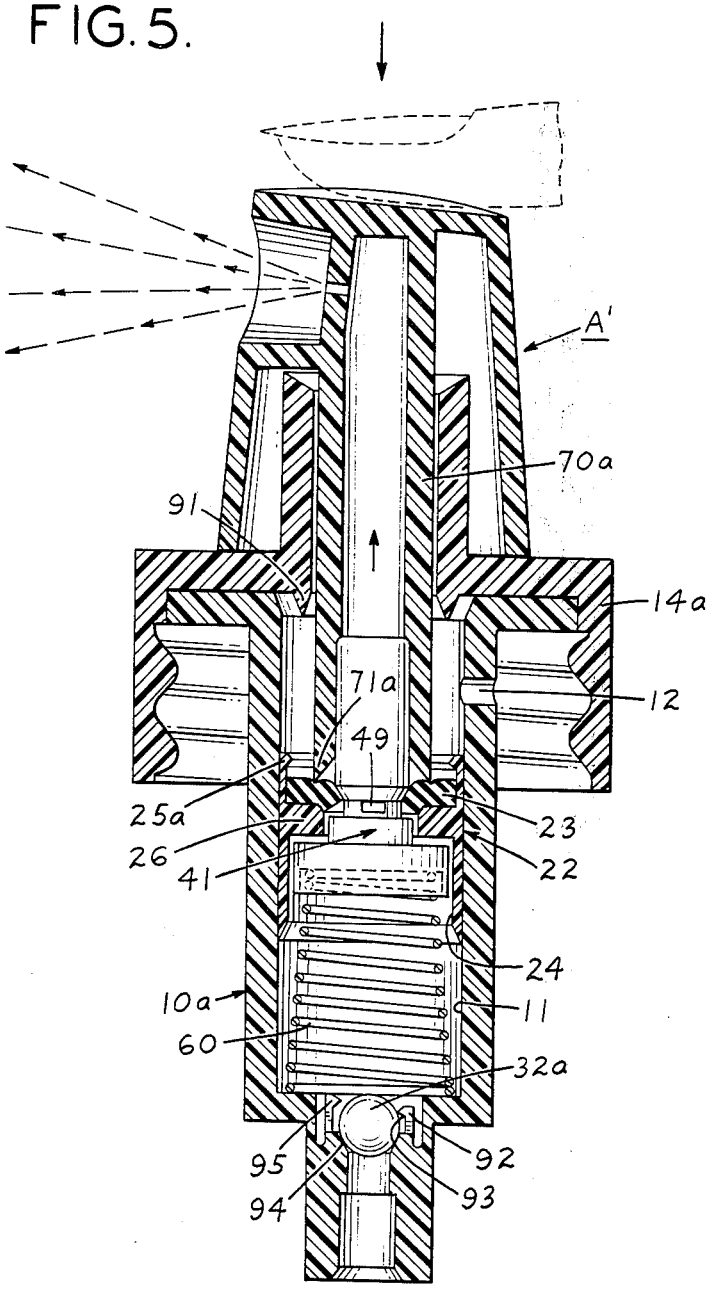
FIG. 5 is an elevational view, partially in vertical section, of the pump of FIG. 4 during the actuation stroke.

FIG. 5 shows the pump during the actuation stroke. Initial downward movement of the actuator button A′ moves the outlet valve member downwardly with respect to the piston to cause the gasket 23 to deflect away from the outlet valve orifice 49 to open the outlet valve. Continued downward movement brings the lower edge 71*a* of the valve stem extension 70*a* into abutment with the gasket 23 to drive the piston downwardly in the chamber 11*a* against the bias of spring 60. Product in the chamber 11*a* is forced through the outlet valve and out the discharge orifice of the actuator button. Downward movement moves the piston skirt 24 away from occlusion of vent 12 in the housing 10*a* to vent the container. Inlet valve ball 32*a* remains closed against seat 94. The resilient fingers 92 prevent the inlet valve ball from chattering or leaving the seat to insure an effective pump stroke.

Figure 6:
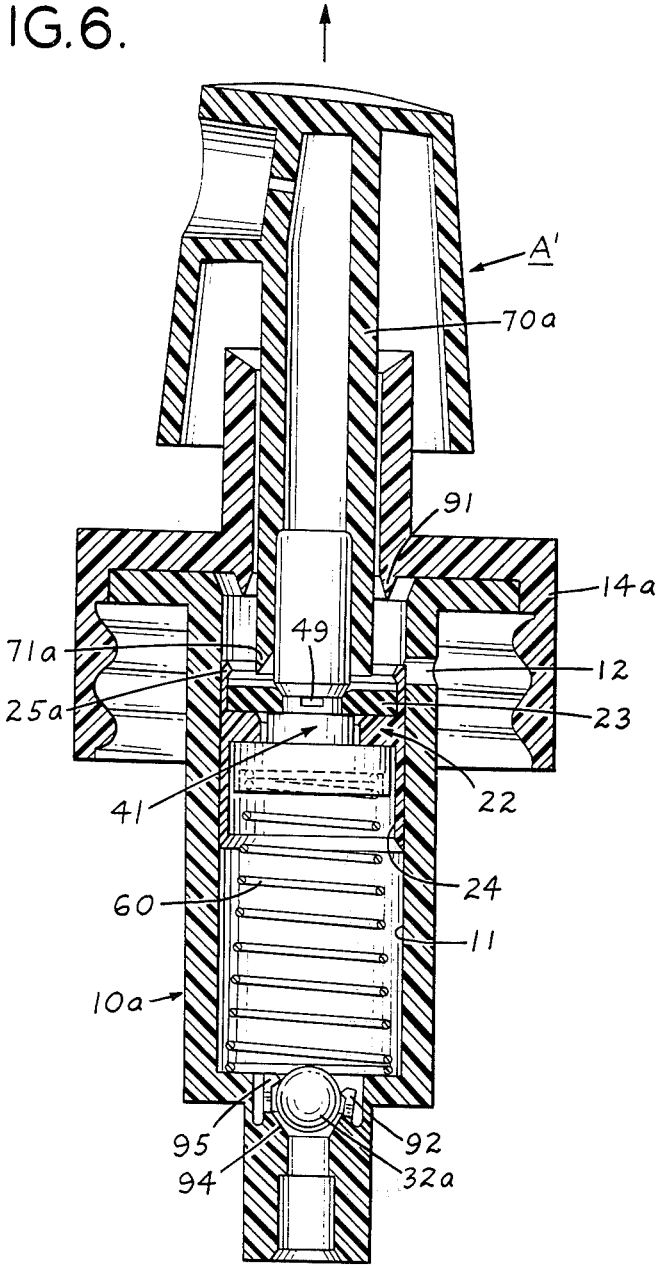
FIG. 6 is an elevational view, partially in vertical section of the pump of FIG. 4 during the return stroke.

FIG. 6 shows the pump during the return stroke. Spring 60 moves the outlet valve member upwardly with respect to the piston to close the outlet valve. The outlet valve member and piston then together move upwardly causing a reduction in pressure in the chamber 11*a*. The outlet valve ball 32*a* lifts off the seat 94 in response to the pressure differential between the vented container and the chamber 11*a*. The outlet valve ball 32*a* lifts off the seat 94 in response to the pressure differential between the vented container and the chamber 11*a*. Upward movement of the ball deflects the resilient fingers 92 radially outwardly, thereby creating a resilient restoring force which tends to close the inlet valve. Upward movement of the inlet valve ball 32*a* is limited by the more rigid retainers 95. Product from the container flows past the inlet valve to fill chamber 11 as the piston retreats upwardly. At the end of the return stroke, the pump assumes the status of FIG. 4.

It should be understood by one skilled in the art that various modifications may be made to the present invention which are within the spirit and scope thereof as described in the specification and defined in the appending claims.

What is claimed is:

1. A dispenser pump which comprises:

a housing including a cylindrical pump chamber;

an outlet valve including an outlet valve body with an upstanding tubular valve stem having an axial product passage and a valve orifice extending transversely through the valve stem into communication with the axial product passage and an annular flexible elastomeric valve orifice sealing gasket, the inner margin of said gasket gripping said valve stem to normally sealingly occlude said valve orifice;

a reciprocable piston including a piston body and said annular gasket, said piston body having a tubular skirt slidingly received in said pump chamber, said annular gasket extending transversely across said piston body and being sealingly engaged with said piston body;

inlet check valve means for controlling flow of product into said pump chamber; and means to bias said piston and outlet valve body upwardly, downward axial movement of said valve stem flexing said annular gasket out of occlusion with said valve orifice and moving said piston in said pump chamber.

2. A pump according to claim 1 wherein said pump is sealingly mounted on a flexible-walled container.

3. A pump according to claim 1 wherein said piston body includes an inwardly extending annular shoulder over which the gasket lies.

4. A pump according to claim 3 wherein the outer margin of the gasket is sealingly gripped between said inwardly extending annular shoulder and a second inwardly extending annular shoulder.

5. A pump according to claim 1 wherein said valve stem comprises:

a downwardly and inwardly tapered, frusto-conical portion;

a reduced diameter neck disposed below said portion;

said valve orifice extending through said neck, the inner margin of said gasket encompassing said neck; and said frusto-conical portion flexing the inner margin of said gasket downwardly out of occlusion with said valve orifice in response to downward axial movement of said valve stem.

6. A pump according to claim 3 wherein said outlet valve body further includes:

an enlarged diameter base at the lower end of said outlet valve body, said base being engageable beneath the inwardly extending annular shoulder of said piston body to move said piston axially upwardly in association with said outlet valve body.

7. A pump according to claim 5 wherein said base includes:

a recess in its underside to receive said means to bias and to retain said means to bias.

8. A pump according to claim 1 wherein said chamber includes:

a transverse pressure relief vent which is occluded by said piston when the pump is at rest.

9. A pump according to claim 3 wherein said valve stem includes a shoulder for engaging said piston upon downward axial movement of said valve stem with respect to said piston to move said piston axially downwardly in association with said outlet valve body.

10. A pump according to claim 9 wherein said outlet valve body further includes:

an enlarged diameter base at the lower end of said outlet valve body, said base being engageable beneath said shoulder of said piston body to move said piston axially upwardly in association with said outlet valve body, and the vertical distance between said base and said valve stem shoulder is greater than the vertical distance between the lower surface of the inwardly extending annular piston shoulder and the surface of the piston which engages said valve stem shoulder.

11. A pump according to claim 1 wherein said chamber includes an eduction passageway and said inlet check valve means includes an axially movable, inlet valve body which comprises a cylindrical inlet valve base, an upstanding inlet valve stem above said base which has an axial inlet passage and an inlet orifice extending transversely through the inlet valve stem into communication with the axial inlet passage, and a cylindrical cap surmounting said inlet valve stem, said inlet passage extending through said inlet valve base and communicating with said eduction passageway, and an annular elastomeric inlet valve sealing gasket extending transversely of said eduction passageway with its outer margin sealed in said housing and its inner margin normally sealingly occluding said inlet orifice, said cylindrical cap limiting downward axial movement of said inlet valve body.

12. A pump according to claim 11 wherein said housing further includes:

a centrally apertured, upwardly and inwardly tapered, frusto-conical valve retainer which defines a clearance chamber for said inlet valve body, the upper surface of said retainer supporting said means to bias said piston and said outlet valve body upwardly.

13. A pump according to claim 1 wherein the inlet check valve means includes a ball, a product entrance port to said pump chamber, a valve seat surrounding said product entrance port against which the ball seals when the inlet check valve means is closed, and resilient means to bias the ball toward the seat.

14. A pump according to claim 13 wherein the resilient means comprise resilient fingers which bear against said ball, said resilient fingers being deflectable radially outwardly by said ball as the ball is moved away from said valve seat.

15. A pump according to claim 14 further including retainer means to limit movement of the ball away from the valve seat.

16. A pump according to claim 15 wherein said retainer means comprise relatively rigid members which engage the ball to limit movement of the ball.

17. A pump according to claim 3 wherein the upper face of said annular gasket is biased into sealing engagement with an annular rib by said means to bias said piston and outlet valve body upwardly when the pump is in the rest position, said annular rib overlying said inwardly extending annular shoulder of said piston.

18. A pump according to claim 17 wherein said annular rib protrudes from a cap member for securing the pump to a container.

* * * * *

UNITED STATES PATENT AND TRADEMARK OFFICE

CERTIFICATE OF CORRECTION

PATENT NO. : 3,949,910

DATED : April 13, 1976

INVENTOR(S) : JOHN RICHARD FOCHT

It is certified that error appears in the above-identified patent and that said Letters Patent are hereby corrected as shown below:

Col. 2, lines 43 and 44, "education" both occurences, should be --eduction--.

Col. 4, line 8, before "tipping", "in" should be --by--.

Signed and Sealed this

Fourteenth Day of September 1976

[SEAL]

*Attest:*

RUTH C. MASON
*Attesting Officer*

C. MARSHALL DANN
*Commissioner of Patents and Trademarks*